US009957689B2

(12) United States Patent
Rochel et al.

(10) Patent No.: US 9,957,689 B2
(45) Date of Patent: May 1, 2018

(54) TILT BUCKET PROFILE AND FRONT STRUCTURE

(71) Applicant: Caterpillar Inc., Peoria, IL (US)

(72) Inventors: Ryan Andrew Rochel, Metamora, IL (US); Julia Kay Nitti, Aurora, IL (US); David Michael Worth, Naperville, IL (US); Davida Ray Reang, Tamil Nadu (IN); Giedre Simanskaite, Lisle, IL (US)

(73) Assignee: Caterpillar Inc., Peoria, IL (US)

( * ) Notice: Subject to any disclaimer, the term of this patent is extended or adjusted under 35 U.S.C. 154(b) by 282 days.

(21) Appl. No.: 14/867,622

(22) Filed: Sep. 28, 2015

(65) Prior Publication Data

US 2017/0089030 A1 Mar. 30, 2017

(51) Int. Cl.
*E02F 3/40* (2006.01)
*E02F 3/36* (2006.01)

(52) U.S. Cl.
CPC ..... *E02F 3/40* (2013.01); *E02F 3/3677* (2013.01)

(58) Field of Classification Search
CPC ..... E02F 3/40; E02F 3/3677
See application file for complete search history.

(56) References Cited

U.S. PATENT DOCUMENTS 4,187,050 A * 2/1980 Barbee ..... E02F 3/3622 172/272
4,477,987 A * 10/1984 Stecklein ..... E02F 3/401 37/444
5,224,816 A 7/1993 Kaczmarczyk et al.
5,815,959 A 10/1998 Bahner et al.
6,000,154 A * 12/1999 Berard ..... E02F 3/3622 37/468
6,186,735 B1 * 2/2001 Deyo ..... E02F 3/40 29/466
6,312,212 B1 11/2001 Burlew, Jr.
6,379,075 B1 * 4/2002 Shamblin ..... E02F 3/3613 37/468
7,882,898 B1 2/2011 Vering et al.
8,015,734 B1 * 9/2011 Mills ..... E02F 3/40 37/444
8,069,593 B2 * 12/2011 McClallen ..... E02F 3/40 37/444
8,201,350 B2 6/2012 Folkerts et al.
8,851,826 B2 10/2014 Nagata et al.
(Continued)

FOREIGN PATENT DOCUMENTS

CN 203613576 U 5/2014
CN 104088308 A 10/2014
(Continued)

*Primary Examiner* — Jamie L McGowan
(74) *Attorney, Agent, or Firm* — Finnegan, Henderson, Farabow, Garrett & Dunner, LLP

(57) ABSTRACT

A tilt bucket may include a front structure having an outer surface, the front structure including a base plate with a bottom surface. The tilt bucket may include a bottom edge and a curved wrapper extending between the base plate and the bottom edge. A ratio of a maximum distance between the curved wrapper and a first line extending from the bottom edge to the tangent point on the outer surface of the front structure, taken substantially perpendicularly from the first line, relative to a length of the first line, may be about 0.64 to 0.70.

7 Claims, 4 Drawing Sheets

(56) References Cited

U.S. PATENT DOCUMENTS

| | | | | |
|---|---|---|---|---|
| 9,139,975 | B2 * | 9/2015 | Rochel | E02F 3/40 |
| 9,447,561 | B2 * | 9/2016 | Nitti | E02F 3/40 |
| 9,732,494 | B2 * | 8/2017 | Honda | E02F 3/40 |
| 2013/0323000 | A1 | 12/2013 | Rochel et al. | |
| 2014/0237869 | A1 | 8/2014 | Caux et al. | |
| 2017/0107688 | A1 * | 4/2017 | Fujii | E02F 3/3681 |

FOREIGN PATENT DOCUMENTS

| | | |
|---|---|---|
| JP | 11-193545 | 7/1999 |
| JP | 2013-217067 | 10/2013 |
| KR | 10-2005-0107980 | 11/2005 |
| WO | WO 2014/171024 A1 | 10/2014 |

* cited by examiner

TILT BUCKET PROFILE AND FRONT STRUCTURE

TECHNICAL FIELD

The present disclosure is directed to a tilt bucket, and more particularly, to a tilt bucket profile and front structure.

BACKGROUND

A machine, such as an excavator, may be equipped with various types of buckets in order to perform operations at a work site. At times, such a machine may be equipped with a tilt bucket in order to enable those operations for which a tilt bucket may be intended. For example, such operations may include ditch cleaning, sloping a surface, grading, and various types of finishing work. The level of performance achieved by an operator using an excavator or other machine with a tilt bucket may depend, at least partially, on one or more parameters of the bucket, and the tilt mechanism associated with the bucket. Using one particular bucket may provide a level of performance that significantly differs from the level achieved while performing similar operations using a different bucket that has one or more different parameters. In addition, operator visibility of the bucket as it engages material may be affected significantly by the particular tilt mechanism necessarily associated with a tilt bucket.

An exemplary machine bucket is disclosed in U.S. Pat. No. 8,201,350 to Folkerts that issued on Jun. 19, 2012 (the '350 patent). Specifically, the '350 patent describes a bucket that includes various parameters designed to enhance the performance of the bucket. The '350 patent discloses various angle values and dimensional ratios intended to improve an operator's visibility and improve the ease with which material may enter the bucket or be dumped from the bucket, for example.

Although the bucket of the '350 patent performs well in general applications, there still is room for improvement. For example, the '350 patent does not address situations that may occur when using a tilt bucket that is designed to pivot, or tilt, from side to side for various operations that may require such a bucket. While the parameters of the bucket of the '350 patent may offer an advantage over other buckets designed for operation about one axis, they may not sufficiently enhance operator visibility where the tilting structure associated with a tilt bucket, designed for operation about more than one axis, must be mounted adjacent the bucket.

The tilt bucket profile and front structure of the present disclosure solve one or more of the problems set forth above and/or other problems of the prior art.

SUMMARY

In one aspect, the present disclosure is directed to a tilt bucket including a front structure having an outer surface, the front structure including a base plate with a bottom surface. The tilt bucket may include a bottom edge and a curved wrapper extending between the base plate and the bottom edge. A ratio of a maximum distance between the curved wrapper and a first line extending from the bottom edge to the tangent point on the outer surface of the front structure, taken substantially perpendicularly from the first line, relative to a length of the first line, may be about 0.64 to 0.70.

In another aspect, the present disclosure is directed to a tilt bucket including a top section with a front structure. The tilt bucket also may include a bottom section including a bottom edge, and a middle section including a wrapper, the wrapper extending between the front structure and the bottom edge. The front structure may include a base plate attached to the wrapper. The front structure also may include a boxed section adjacent a first end portion of the base plate. The front structure also may include a first tilt plate attached to the boxed section; and a second tilt plate attached adjacent a second end portion of the base plate.

In yet another aspect, the present disclosure is directed to a tilt bucket including a front structure having a base plate and including a boxed section. The tilt bucket may include a bottom edge, a curved wrapper extending between the bottom edge and the front structure, and a pair of sides attached to the front structure, the bottom edge, and the curved wrapper. The boxed section may include a bent plate attached to the base plate. A ratio of a maximum distance between the curved wrapper and a first line extending from the bottom edge to a tangent point on the bent plate, taken substantially perpendicularly from the first line, relative to a length of the first line, may be about 0.64 to 0.70.

DETAILED DESCRIPTION

FIGS. 1-4 illustrate an exemplary disclosed tilt bucket 10. Tilt bucket 10 may be a component of a machine (not shown). The machine may embody a mobile machine, such as an excavator or any other machine, that may perform operations associated with an industry, including, for example, mining, construction, farming, or transportation. The machine may include a linkage assembly (not shown) coupled to tilt bucket 10, including one or more supporting members and actuators for moving tilt bucket 10 to perform operations, including engaging, scooping, lifting, transporting, lowering, and dumping material. Generally, tilt bucket 10 may pivot relative to the linkage assembly about a first axis extending in a direction generally transverse to the linkage and the bucket. In addition, tilt bucket 10 may include an associated tilt structure configured and arranged to tilt the bucket from side to side about a second axis extending in a direction generally perpendicular to the direction of the first axis.

Figure 1:
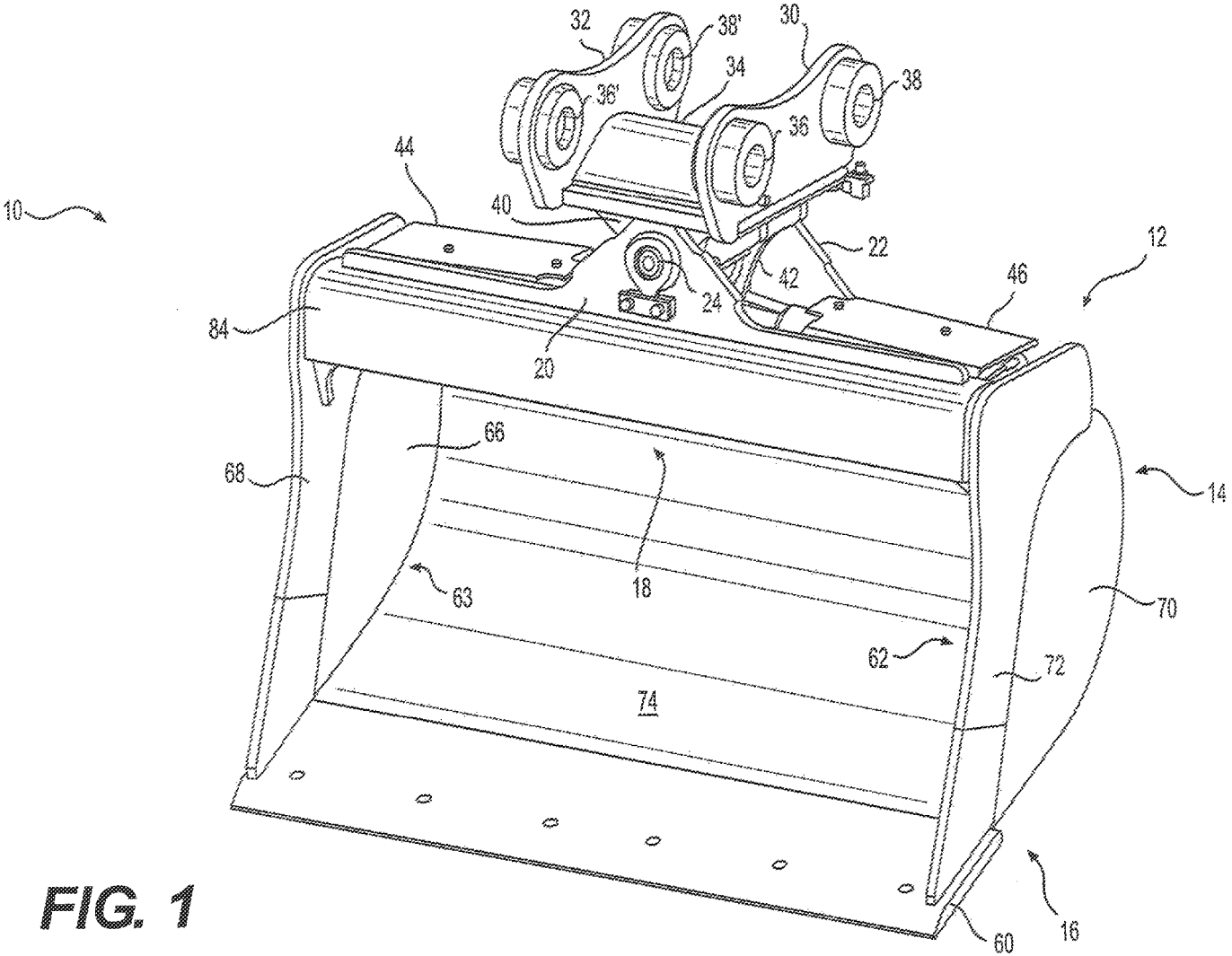
FIG. 1 is a perspective view illustration of an exemplary disclosed tilt bucket.

Referring to FIG. 1, for example, tilt bucket 10 may include a top section 12, a middle section 14, and a bottom section 16. Top section 12 may include a front structure 18. Front structure 18 may include a first tilt plate 20 and a second tilt plate 22. Tilt pin 24 may be mounted to first and second tilt plates 20, 22 via first boss 26 and second boss 28 (not visible in FIG. 1, but visible in FIG. 3). Tilt bucket 10 also may include structure configured to be attached to linkage of a machine. To that end, a first hinge plate 30 and a second hinge plate 32 may be coupled to a support member 34 in spaced relationship. First hinge plate 30 may include a front pin bore 36 and a back pin bore 38, configured to receive first and second pins (not shown) of the linkage assembly of the machine, thereby operatively coupling bucket 10 to the machine. Second hinge plate 32 may include similar front and back pin bores 36', 38'. Support member 34 may include depending tilt plates 40, 42 (see FIG. 2), including suitable apertures for receiving tilt pin 24 and a cylinder pin 25 for suitable actuators 41, 43 (not visible in FIG. 1 but visible in FIG. 4). Actuators 41, 43, e.g., hydraulic cylinders, may be housed within front structure 18 and may be covered by protective members 44, 46, for example.

Figure 2:
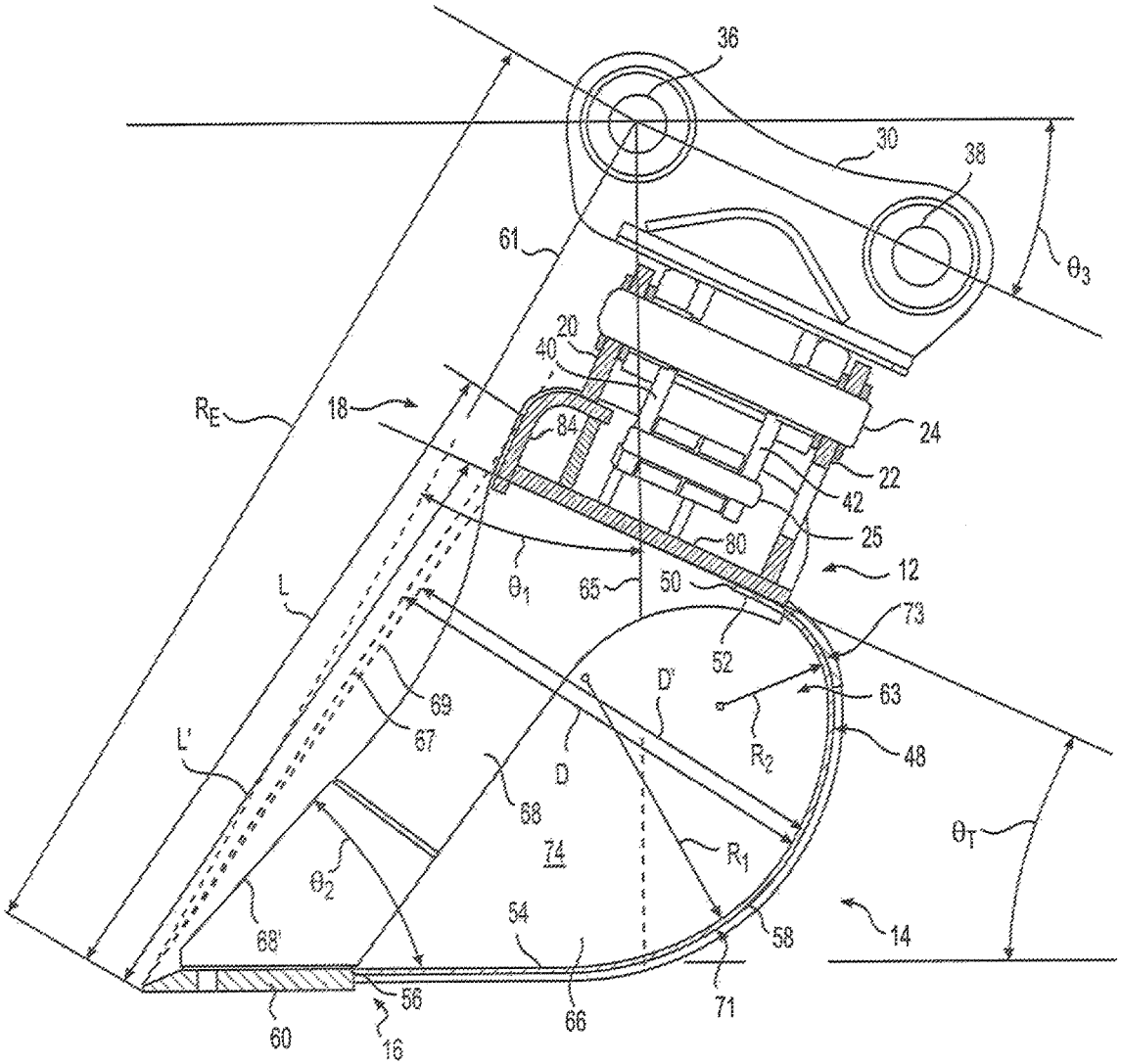
FIG. 2 is a side view illustration of a portion of the tilt bucket of FIG. 1.

Turning to FIG. 2, tilt bucket 10 is illustrated in side view and partial cross-section. Middle section 14 may include a curved wrapper 48 having a first end 50, a substantially flat upper portion 52, a substantially flat lower portion 54, a second end 56, and a curved heel 58 extending between the upper and lower portions 52 and 54. Lower portion 54 may be coupled to a bottom edge 60 of bottom section 16. For example, bottom edge 60 may be welded to second end 56 of curved wrapper 48. Bottom edge 60 may be configured to engage and penetrate material. Bottom section 16 also may include one or more ground engaging tools (not shown), e.g., replaceable ground engaging edge members, etc.

Tilt bucket 10 also may include a first side 62 and a second side 63. First side 62 is visible in FIGS. 1 and 4, but only second side 63 is visible in FIG. 2 since first side 62 has been removed from FIG. 2 to illustrate interior features of tilt bucket 10. First side 62 may be coupled to a first edge of front structure 18, curved wrapper 48, and bottom edge 60, while second side 63 may be coupled to a second edge of front structure 18, curved wrapper 48, and bottom edge 60. The second edge may be located opposite the first edge. As shown in FIG. 2, second side 63 may include a side plate 66 and a side bar 68. First side 62 also may include a side plate 70 and a side bar 72 (see FIGS. 1 and 4) similar to side plate 66 and side bar 68 of second side 63. Front structure 18, curved wrapper 48, bottom edge 60, first side 62, and second side 63, together, may define a receptacle 74 configured to receive material.

Figure 3:
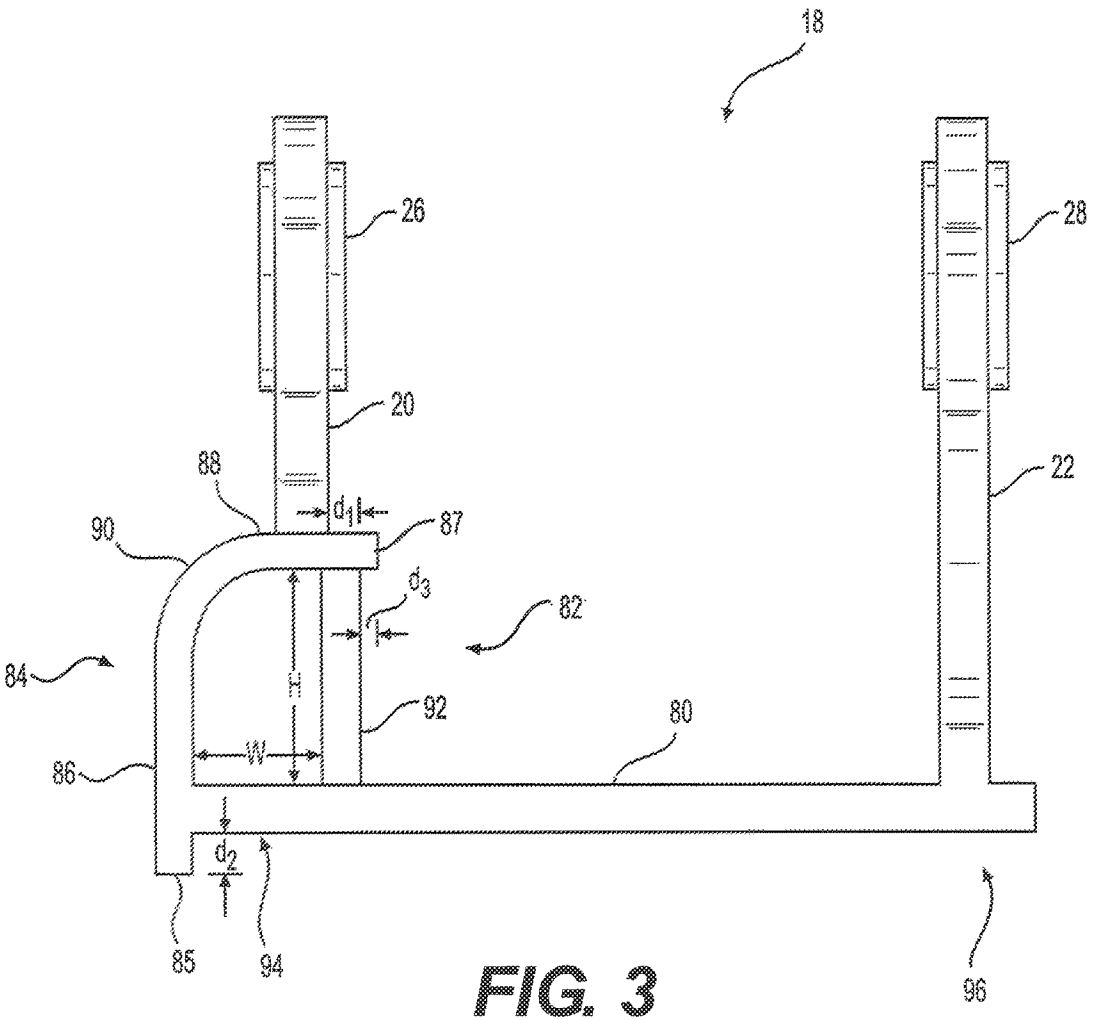
FIG. 3 is a detail view of a portion of the tilt bucket of FIG. 1.
Figure 4:
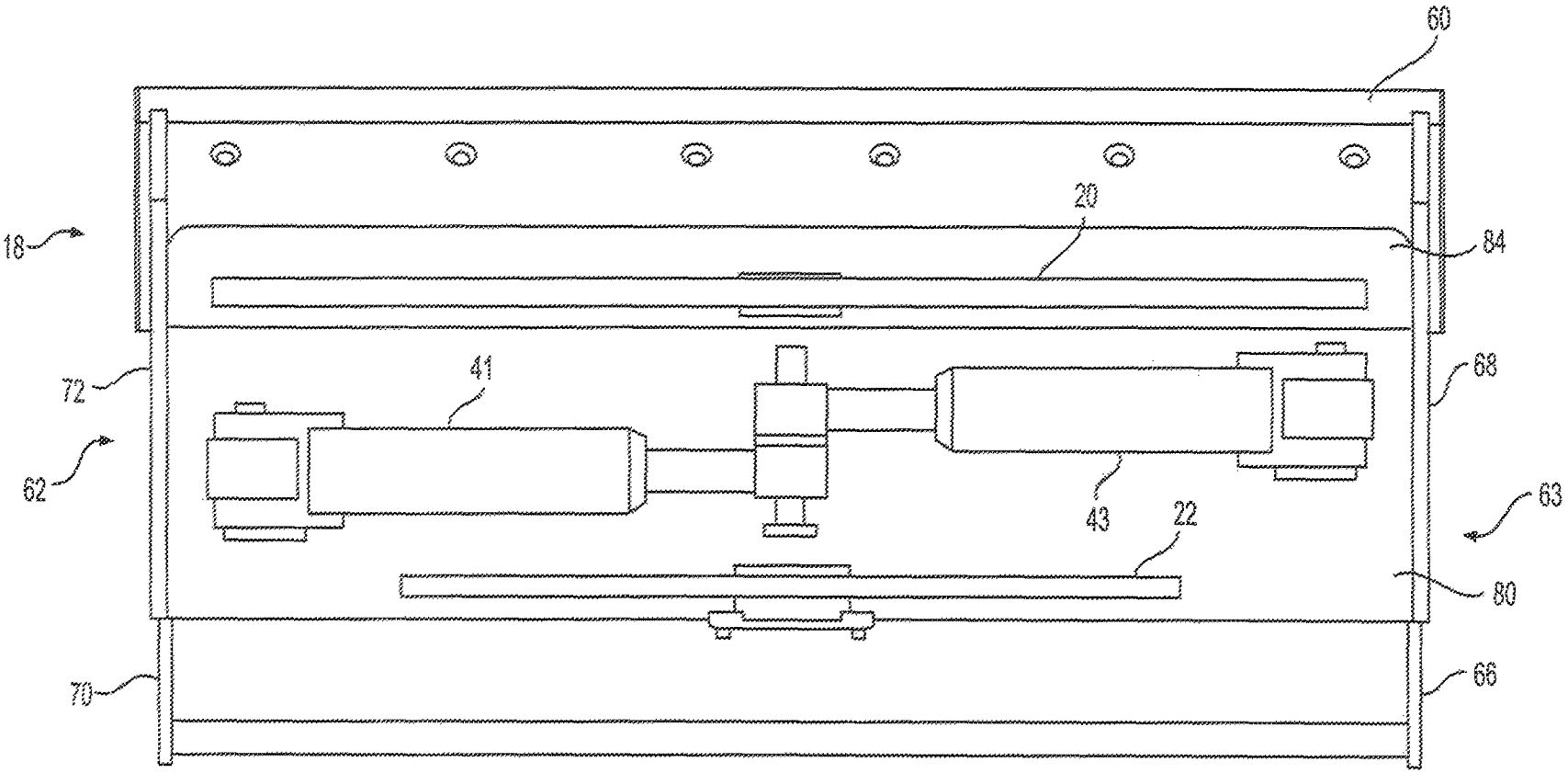
FIG. 4 is a top view illustration of the tilt bucket of FIG. 1.

FIG. 3 illustrates details of front structure 18. Front structure 18 may include a base plate 80. Base plate 80 may be attached to a surface of substantially flat upper portion 52 of wrapper 48 as illustrated in FIG. 2. Front structure 18 also may include a boxed section 82 formed adjacent a first end portion 94 of base plate 80. Boxed section 82 may include a bent plate 84 attached to base plate 80. Bent plate 84 may include a first end 85, a first portion 86, a second end 87, and a second portion 88. First portion 86 may be connected to second portion 88 by a curved portion 90, and first portion 86 may be substantially perpendicular to second portion 88. A support plate 92 may extend between base plate 80 and second portion 88 of bent plate 84.

As illustrated in FIG. 3, boxed section 82 of front structure 18 may be formed by bent plate 84, support plate 92, and end portion 94 of base plate 80. In addition, support plate 92 may be substantially parallel to first portion 86 of bent plate 84, and base plate 80 may be substantially parallel to second portion 88 of bent plate 80. First tilt plate 20 may be attached to boxed section 82 and may extend from bent plate 84. For example, first tilt plate 20 may extend substantially perpendicularly from second portion 88 of bent plate 84, and may be extend substantially parallel to support plate 92 and first portion 86 of bent plate 84. In addition, first tilt plate 20 may be offset from support plate 92. Second tilt plate 22 may be attached adjacent a second end portion 96 of base plate 80 and may extend substantially perpendicularly from base plate 80 and substantially parallel to first tilt plate 20. First tilt plate 20 may include first boss 26, and second tilt plate 22 may include second boss 28, configured to receive tilt pin 24 (see FIGS. 1 and 2).

It may be advantageous to form front structure 18, particularly boxed section 84, so as to conform to certain parameters. These parameters may vary somewhat, for example depending on the type and size of bucket on which front structure 18 may be employed. For example, the width W of boxed section 82 may be approximately 65 mm or greater, and the height H of boxed section 82 may be approximately 107 mm or greater. First tilt plate 20 may be offset from support plate 92 by a distance of 15 mm or greater. For example, first tilt plate 20 may be offset from support plate 92 by a distance between 15 mm and 25 mm.

In a first example of front structure 18, the width W of boxed section 82 may be approximately 51 mm, and the height H of boxed section 82 may be approximately 67 mm. The offset distance $d_1$ from first tilt plate 20 to support plate 92 may be approximately 15 mm. The distance $d_2$ from base plate 80 to first end 85 of bent plate 84 may be approximately 20 mm. The distance $d_3$ from support plate 92 to second end 87 of bent plate 84 may be approximately 10 mm.

In a second example of front structure 18, the width W of boxed section 82 may be approximately 65 mm, and the height H of boxed section 82 may be approximately 107 mm. The offset distance $d_1$ from first tilt plate 20 to support plate 92 may be approximately 17 mm. The distance $d_2$ from base plate 80 to first end 85 of bent plate 84 may be approximately 20 mm. The distance $d_3$ from support plate 92 to second end 87 of bent plate 84 may be approximately 10 mm.

In exemplary embodiments of front structure 18, the ratio of width W to height H may vary between about 0.5 and about 1.0. The distance $d_1$ from first tilt plate 20 to support plate 92 advantageously may be greater than 15 mm. The distance $d_2$ from base plate 80 to first end 85 of bent plate 84 may be approximately 20 mm. The distance $d_3$ from support plate 92 to second end 87 of bent plate 84 may be approximately 10 mm. To reiterate, parameters may vary depending on the shape and size of the bucket with which front structure 18 is associated.

A number of bucket parameters are identified in FIG. 2. These bucket parameters may include, for example, an edge radius $R_E$, an edge forward angle $\theta_1$, a depth D, a depth D', a length L, a length L', a lower wrapper radius $R_1$, an upper wrapper radius $R_2$, a baseplate angle $\theta_T$, a side bar angle $\theta_2$, and a pin angle $\theta_3$.

As shown in FIG. 2, edge radius $R_E$ (also referred to as a tip radius) may be a distance between a center of upper pin bore 36 and an edge of bottom section 16. The edge of bottom section 16 may include a point on bottom edge 60 farthest away from front pin bore 36.

Edge forward angle $\theta_1$ may be an angle formed between an edge forward line 61 and a line 65. Edge forward line 61 may extend from a center of front pin bore 36 to the edge of bottom section 16, such as the forward most point of bottom edge 60. Line 65 may extend substantially perpendicularly from lower portion 54 of curved wrapper 48 and through the center of front pin bore 36. It should be noted that the term "plane" may be substituted for the term "line" with respect to any of the lines used to define the parameters of tilt bucket 10.

A first throat line 67 may extend between a forward most point of bottom edge 60 and a tangent point on the outer surface of bent plate 84 of front structure 18. The position of first throat line 67 may be found by drawing a line that extends from the forward most point of bottom edge 60 to bent plate 84 of front structure 18, the line being substantially tangential to an outer surface of bent plate 84 and terminating at the tangent point on curved portion 90 of bent plate 84. Length L may be a length of first throat line 67. Depth D may be a length of the longest line extending substantially perpendicularly from first throat line 67 to curved wrapper 48, i.e., a maximum distance between the curved wrapper 48 and the first throat line 67.

A second throat line 69 may extend between the forward most point of bottom edge 60 and a portion of bent plate 84 where base plate 80 would intersect with the front of bent plate 84. This portion of bent plate 84 may be a point at which a line defining a lower surface of base plate 80 intersects an outer surface of bent plate 64. Length L' may be a length of second throat line 69. Depth D' may be a length of the longest line extending substantially perpendicularly from second throat line 69 to curved wrapper 48.

As shown in FIG. 3, a lower heel portion 71 of curved heel 58 may extend between lower portion 54 of curved wrapper 48 and an upper heel portion 73 of curved heel 58. Lower heel portion 71 may approximate a portion of a circle having a radius $R_1$ (referred to herein as lower wrapper radius $R_1$). Upper heel portion 73 may extend between lower heel portion 71 and upper portion 52 of wrapper 48. Upper heel portion 73 may approximate a portion of a circle having a radius $R_2$ (referred to herein as upper wrapper radius $R_2$).

As disclosed, curved wrapper 48 includes a first end 50, a substantially flat upper portion 52, a substantially flat lower portion 54, a second end 56, and a curved heel 58 extending between the upper and lower portions 52 and 54, with curved heel 58 including lower heel portion 71 with lower wrapper radius $R_1$ and upper heel portion 73 with upper wrapper radius $R_2$. It should be understood that the several regions of curved wrapper 48 may transition smoothly, one to the other. In other words, substantially flat upper portion 52 may begin to curve slightly as it transitions to upper heel portion 73, and upper heel portion 73 may have a radius somewhat greater than $R_2$ adjacent that location. Similarly, substantially flat lower portion 54 may begin to curve slightly as it transitions to lower heel portion 71, and lower heel portion 71 may have a radius somewhat greater than $R_1$ adjacent that location. In addition, lower heel portion 71 and upper heel portion 73 may transition gradually, one to the other, with the radius of lower heel portion gradually decreasing and the radius of upper heel portion gradually increasing adjacent the location of transition.

Referring to FIG. 2, baseplate angle $\theta_T$ (also referred to as body angle) may be an angle between a top surface of bottom edge 60 and a bottom surface of baseplate 80. Additionally or alternatively, baseplate angle $\theta_T$ may be an angle between substantially straight upper and lower portions 52 and 54 of curved wrapper 48.

Side bar angle $\theta_2$ also is shown in FIG. 2. Side bar angle $\theta_2$ may be an angle between a surface of lower portion 54 and a lower edge portion 68' of side bar 68. Pin angle $\theta_3$ may be an angle formed between a line extending between front pin bore 36 and back pin bore 38, and a line parallel to the substantially flat lower portion 54 of curved wrapper 48.

In a first example, tilt bucket 10 may have an edge radius $R_E$ of approximately 1,092 mm, an edge forward angle $\theta_1$ of approximately 29.3°, a depth D of approximately 495.5 mm, a length L of approximately 704.4 mm, a ratio of D/L of approximately 0.70, a depth D' of approximately 488.4 mm, a length L' of approximately 643.1 mm, a ratio of D'/L' of approximately 0.759, a lower wrapper radius $R_1$ of approximately 360 mm, an upper wrapper radius $R_2$ of approximately 80 mm, radius ratio of $R_2/R_1$ of approximately 0.22, a baseplate angle $\theta_T$ of approximately 25°, and a side bar angle $\theta_2$ of approximately 47.5°.

In a second example, bucket 10 may have an edge radius $R_E$ of approximately 1.145 mm, an edge forward angle $\theta_1$ of approximately 29.3°, a depth D of approximately 515.7 mm, a length L of approximately 756.9 mm, a ratio of D/L of approximately 0.68, a depth D of approximately 509.4 mm, a length L' of approximately 695.9 mm, a ratio of D'/L' of approximately 0.732, a lower wrapper radius $R_1$ of approximately 350 mm, an upper wrapper radius $R_2$ of approximately 80 mm, a radius ratio of $R_2/R_1$ of approximately 0.23, a hinge support plate angle $\theta_T$ of approximately 25°, and a side bar angle $\theta_2$ of approximately 47.5°.

In a third example, bucket 10 may have an edge radius $R_E$ of approximately 1,260 mm, an edge forward angle $\theta_1$ of approximately 29.5°, a depth D of approximately 558.5 mm, a length L of approximately 825.5 mm, a ratio of D/L of approximately 0.68, a depth D' of approximately 546.8 mm, a length L' of approximately 725.6 mm, a ratio of D'/L' of approximately 0.753, a lower wrapper radius $R_1$ of approximately 350 mm, an upper wrapper radius $R_2$ of approximately 80 mm, a radius ratio of $R_2/R_1$ of approximately 0.23, a baseplate angle $\theta_T$ of approximately 25°, and a side bar angle $\theta_2$ of approximately 47.5.

INDUSTRIAL APPLICABILITY

The disclosed tilt bucket may enhance machine performance, particularly in those operations for which a tilt bucket is generally employed. The performance enhancement achieved by the disclosed tilt bucket may result from the front structure associated with the tilt mechanism and the upper portion of the bucket, as well as from several tilt bucket parameters.

Front structure 18 of tilt bucket 10 is designed to handle stresses running through the main load path of the tilt bucket to ensure a robust machine that can withstand the forces inherent in the use of a tilt bucket. Compact boxed section 82 is dimensioned to ensure adequate reinforcement while its overall open framework provides ample space at the upper portion of the bucket to house actuators, hoses, and other components employed with the tilt mechanism. The compact nature of front structure 18 is a space-saving arrangement that does not interfere with operator visibility of the from portion of the tilt bucket. It also allows for a minimized edge radius (tip radius) for the tilt bucket. This may significantly increase break out force.

Enhanced performance of tilt bucket 10 may result from its various parameter values. For example, the disclosed ratio of D/L may be between about 0.64 to 0.70. This ratio may provide a shallow profile of tilt bucket 10. This may improve the ease with which material may be loaded to capacity and dumped, enhance release of sticky materials, and increase operator visibility.

The disclosed radius ratio of $R_2/R_1$ may be about 0.10 to 0.50. This ratio may help to ensure that tilt bucket 10 has a shape with the above-described shallow profile that improves the ease of dumping and filling of tilt bucket 10, and helps to prevent material from sticking to inner surfaces of bucket 10.

The disclosed edge forward angle value $\theta_1$ may range from approximately 28° to 30°. This edge forward angle $\theta_1$ value may provide a machine operator with line of sight to a forward most point of a bottom section 16 of tilt bucket 10, such as a forward most point of bottom edge 60 of tilt bucket 10. As the machine operator moves material with tilt bucket 10, this line of sight may provide the machine operator with the ability to move and place tilt bucket 10 accurately. Thus, unnecessary bucket movements may be avoided. Accordingly, operations may be performed more quickly, and the amount of material moved per unit of fuel may be increased, producing cost savings.

Further, the disclosed edge forward angle $\theta_1$ may provide the machine operator with line of sight into at least a portion of a receptacle 74 of tilt bucket 10. This may provide the machine operator with the ability to visually determine, during filling, whether tilt bucket 10 is fully filled with material or has additional capacity for material. Thus, the machine operator may avoid wasting time trying to fill a full bucket with additional material or performing operations with only partially filled buckets. This also may improve visibility and aid an operator in providing a flat edge for grading and clean-up operations.

The disclosed baseplate angle $\theta_T$ may be about 25°. This baseplate angle $\theta_T$ may have an effect on its capacity. If the baseplate angle $\theta_T$ of the tilt bucket is smaller than the disclosed value, the bucket may be too deep, which can increase cycle times with added travel time for material entering into and exiting out of the tilt bucket. If baseplate angle $\theta_T$ of the tilt bucket is larger than the disclosed values, the hinge strength may be affected, thus reducing the life of the bucket. The disclosed baseplate angle $\theta_T$ may enhance bucket curl, yielding better material holding ability, and enhance the rack back angle, permitting ease of digging and clean-up.

The disclosed side bar angle $\theta_2$ may be about 47.5°. Providing a side bar angle $\theta_2$ at about 47.5° may help enhance visibility to the machine operator, while ensuring the ability of tilt bucket 10 to penetrate material. For example, if the side bar angle $\theta_2$ is too small, the tilt bucket may not be able to sufficiently penetrate the material. On the other hand, if the side bar angle $\theta_2$ is too large, it may impair the operator's visibility, which may hurt efficiency.

It will be apparent to those skilled in the art that various modifications and variations can be made in the disclosed tilt buckets without departing from the scope of the disclosure. As evidence by the various examples disclosed, some variability of the values for tilt bucket parameters, including front structure parameters, is contemplated. For example, values may vary depending on the desired overall size of tilt bucket 10, including front structure 18, and/or parameters associated with the linkage assembly used to couple tilt bucket 10 to a machine. Additionally, other embodiments of the disclosed tilt buckets will be apparent to those skilled in the art from consideration of the specification. It is intended that the specification and examples be considered as exemplary only, with a true scope of the disclosure being indicated by the following claims and their equivalents.

What is claimed is:

1. A tilt bucket, comprising:

a top section including a front structure;

a bottom section including a bottom edge; and a middle section including a wrapper, the wrapper extending between the front structure and the bottom edge;

wherein the front structure includes:

a base plate attached to the wrapper;

a boxed section adjacent a first end portion of the base plate;

a first tilt plate attached to the boxed section; and a second tilt plate attached adjacent a second end portion of the base plate wherein the boxed section includes a bent plate attached to the base plate, and a support plate extending between the base plate and the bent plate, and wherein the bent plate is attached to the base plate approximately 20 mm from a first end of the bent plate, and the bent plate is attached to the support plate approximately 10 mm from a second end of the bent plate.

2. The tilt bucket of claim 1, wherein the support plate is substantially parallel to a first portion of the bent plate, and the base plate is substantially parallel to a second portion of the bent plate.

3. The tilt bucket of claim 2, wherein the distance between the support plate and the first portion of the bent plate is approximately 65 mm or greater, and the distance between the base plate and the second portion of the bent plate is approximately 107 mm or greater.

4. The tilt bucket of claim 2, wherein the first tilt plate extends substantially perpendicularly from the second portion of the bent plate and parallel to the support plate and the first portion of the bent plate.

5. The tilt bucket of claim 4, wherein the first tilt plate is offset from the support plate by a distance of 15 mm or greater.

6. The tilt bucket of claim 5, wherein the first tilt plate is offset from the support plate by a distance of between 15 mm and 25 mm.

7. The tilt bucket of claim 2, wherein the ratio of the distance between the support plate and the first portion of the bent plate to the distance between the base plate and the second portion of the bent plate is between 0.5 and 1.0.

* * * * *